US010531707B2

(12) United States Patent
Lockwood

(10) Patent No.: US 10,531,707 B2
(45) Date of Patent: Jan. 14, 2020

(54) ACCESSORY FOR FOOTWEAR

(71) Applicant: Mary E. Lockwood, Aurora, MN (US)

(72) Inventor: Mary E. Lockwood, Aurora, MN (US)

( * ) Notice: Subject to any disclaimer, the term of this patent is extended or adjusted under 35 U.S.C. 154(b) by 72 days.

(21) Appl. No.: 16/013,453

(22) Filed: Jun. 20, 2018

(65) Prior Publication Data

US 2018/0360166 A1 Dec. 20, 2018

Related U.S. Application Data

(60) Provisional application No. 62/522,426, filed on Jun. 20, 2017.

(51) Int. Cl.

| | |
|---|---|
| ***A41D 17/00*** | (2006.01) |
| ***A43B 23/24*** | (2006.01) |
| ***A41F 17/04*** | (2006.01) |
| ***A41D 13/05*** | (2006.01) |
| ***A41D 27/08*** | (2006.01) |

(52) U.S. Cl.

CPC ..... *A43B 23/24* (2013.01); *A41D 13/0543* (2013.01); *A41D 17/005* (2013.01); *A41D 27/08* (2013.01); *A41F 17/04* (2013.01); *A41D 2300/32* (2013.01)

(58) Field of Classification Search

CPC ..... A41D 17/00; A41D 17/005; A41D 17/02; A41F 17/04

See application file for complete search history.

(56) References Cited

U.S. PATENT DOCUMENTS

| | | | | |
|---|---|---|---|---|
| 258,996 | A | | 6/1882 | Cory |
| 562,784 | A | | 6/1896 | Fisher |
| 755,694 | A | | 3/1904 | Peel |
| 1,153,977 | A | | 9/1915 | Tweedie |
| 1,236,328 | A | | 8/1917 | Mackey |
| 1,265,280 | A | | 5/1918 | Tweedie |
| 1,368,771 | A | | 2/1921 | Tweedie |
| 1,564,056 | A | | 12/1925 | Friedman et al. |
| 1,664,617 | A | | 4/1928 | Friedenthal |
| D104,880 | S | * | 6/1937 | Rosenfield ..... D2/901 |
| 2,126,022 | A | * | 8/1938 | Manolis ..... A41D 17/00 36/2 R |
| 2,446,158 | A | | 7/1948 | Miller et al. |
| 4,393,522 | A | * | 7/1983 | Calabrese ..... A41F 17/00 36/2 R |
| 5,501,022 | A | | 3/1996 | Cohn |

(Continued)

*Primary Examiner* — Ted Kavanaugh

(74) *Attorney, Agent, or Firm* — Patterson Thuente Pedersen, P.A.

(57) ABSTRACT

An interchangeable over-ankle band for the display of an ornamental design on the outside of a lower leg of a wearer. The interchangeable over ankle band including a lower leg cuff having two loose ends, the ends each including fasteners configured to selectively couple the lower leg cuff into a loop surrounding the wearer's lower leg, the lower leg cuff further including an outer surface operating as a substrate for the display of an ornamental design or logo, an interchangeable over-ankle band having a supporting layer coupled to the lower leg cuff with a rigidity greater than that of the lower leg cuff, wherein the bottom edge of the supporting layer is coupled to a ring member, which is in turn coupled with an adjustable-length stirrup strap, enabling the wearer to adjust the stirrup strap to snugly fit her or his footwear outsole.

6 Claims, 4 Drawing Sheets

(56) References Cited

U.S. PATENT DOCUMENTS

| | | | | |
|---|---|---|---|---|
| 5,740,559 | A | 4/1998 | Thiel | |
| 6,301,803 | B1 | 10/2001 | Patterson | |
| 9,210,959 | B1 | 12/2015 | Jankowski | |
| 9,254,015 | B2 | 2/2016 | Nugent | |
| 2011/0191942 | A1* | 8/2011 | Villalobos | A41B 11/00 2/240 |
| 2014/0130227 | A1* | 5/2014 | Stark | A41F 17/02 2/59 |
| 2014/0283415 | A1* | 9/2014 | Brown | A43B 3/0078 36/2 R |
| 2016/0044978 | A1* | 2/2016 | Callaway | A41D 17/005 2/22 |

* cited by examiner

ACCESSORY FOR FOOTWEAR

RELATED APPLICATION

The present application claims the benefit of U.S. Provisional Application No. 62/522,426 filed Jun. 20, 2017, which is hereby incorporated herein in its entirety by reference.

TECHNICAL FIELD

Embodiments of the present disclosure relate generally to garments and footwear. More particularly, embodiments of the present disclosure relate to decorative leg coverings that can be removably applied to a lower leg of a wearer.

BACKGROUND

People of all backgrounds are often deeply conscious of and passionate about style and fashion. Footwear, in particular, may be of special importance to fashion-conscious individuals. However, many articles of footwear, especially in the latest popular fashions, are frequently expensive, costing more than many consumers can reasonably afford.

Cowboy boots and biker boots are a particularly popular choice for footwear fashion. The range and variety of boot styles is limitless, with all type of embroideries, decorative stitches, stamped designs, linings, rivets, studs, rhinestones, jewels, gems, hems, charms, chains, inlays, feathers, fringes, and frills. Alas, cowboy boots of average quality cost hundreds of dollars; high-end handcrafted boots may even cost thousands of dollars. Biker boots start at just below one hundred dollars. Fashion-conscious boot-wearers may wish to own many pairs, but for the prohibitive cost of such a luxury.

Furthermore, many people do not live in a house or apartment spacious enough to store a large quantity of boot pairs. When traveling, it is inconvenient to carry several pairs of footwear, especially bulky boots. Additionally, many consumers may find changing between numerous boot pairs to be cumbersome and inefficient.

Much of the prior art in the area of over-shoe coverings provides for utilitarian protection from the elements, especially water infiltration. U.S. Pat. No. 258,996 issued to Cory, incorporated herein by reference, describes a waterproof legging, known in its day as a "gossamer," featuring an elastic support garter, and secured with an underfoot strap. The gossamer is fastened around the lower leg with a vertical row of buttons or other fasteners. U.S. Pat. No. 562,784 issued to Fisher, incorporated herein by reference, describes an improved legging for gentlemen's wear to be worn over the trousers to serve as protection against wet and stormy weather, and as a covering to provide greater warmth to the wearer's lower legs in cold weather. U.S. Pat. No. 755,694 issued to Peel, incorporated herein by reference, describes an improved legging secured by eyelets and hooks that covers and adheres closely to the upper portion and lace-opening of a boot or shoe for the purpose of preventing ingress of snow, water, or other foreign substances. U.S. Pat. No. 1,236,328 issued to Mackey, incorporated herein by reference, describes an improved legging secured releasably connected along the front with an improved lace-and-hook fastener, and having an improved protective tongue element. U.S. Pat. Nos. 1,153,977; 1,265,280; and 1,368,771 issued to Tweedie, incorporated herein by reference, describe removable over-gaiters having an underfoot strap, and fastened along the front with laces. U.S. Pat. No. 1,564,056 issued to Friedman & Friedman, incorporated herein by reference, describes improved leggings secured to the wearer's lower leg using a zipper or fastener. U.S. Pat. No. 1,664,617 issued to Friedenthal, incorporated herein by reference, describes a wool spat to serve as a protective covering for the wearer's lower limbs, which includes woolen hose secured elastically to the wearer's leg, and having a detachable underfoot strap.

Other prior art relates to removable over-footwear accessories that render a single pair of footwear into a fashion statement. U.S. Pat. No. 2,446,158 issued to Miller & Easterling, incorporated herein by reference, describes an optionally removable cowboy boot upper for children, which may be applied to a wearer's shoe to simulate the appearance of a complete cowboy boot. U.S. Pat. No. 5,501,022 issued to Cohn, incorporated herein by reference, describes a dress boot having optionally interchangeable decorative tubular upper portions, which slide over a wearer's boot. U.S. Pat. No. 5,740,559 issued to Thiel, incorporated herein by reference, describes a tubular footwear accessory designed to simulate the appearance of a boot. U.S. Pat. No. 6,301,803 issued to Patterson, incorporated herein by reference, describes synthetic fleece leggings having an underfoot strap, and secured to the wearer's lower leg with several hook-and-pile (i.e., VELCRO™) fasteners. U.S. Pat. No. 9,210,959 issued to Diamond Dust Design LLC, incorporated herein by reference, describes a selectively decorative "shin wrap" article, which has grommets and jeweler's hooks for temporary fastening of decorative elements, such as chains. U.S. Pat. No. 9,254,015 issued to Nugent, incorporated herein by reference, describes an interchangeable decorative bootleg cover worn over the upper portion of a boot.

Although numerous innovations relating to footwear coverings, decorations, and embellishments are provided in the prior art, no such innovation is suited for the purposes of the embodiments of the present disclosure, namely the featured display of designs or logos on the wearer's lower leg.

SUMMARY OF THE DISCLOSURE

Embodiments of the present disclosure provide wearers with a universal, easily interchangeable and moveable decorative over-ankle band fashion accessory, which embellishes the lower leg, but not the foot, of the wearer with a decorative covering. Embodiments of the present disclosure also help secure the wearer's trouser legs so as to prevent the wearer's trouser legs from rising, for example, when bending at the knee, or, for another example, due to wind while riding a motorcycle or bicycle. Embodiments of the present disclosure additionally protect the wearer from dust and dirt; insects, spiders, ticks, and the like; harm from collisions and falls; and catching of a wearer's trouser material, for example in a bicycle gear mechanism. Embodiments of the present disclosure further provide the wearer additional ankle support; and provide warmth to the covered area.

Embodiments of the present disclosure include a lower leg wrap portion, which consists of a strip of material that may be reversibly secured into a loop around the wearer's lower leg, and an adjustable-length stirrup strap, operably coupled to the lower leg loop portion, which is easily applied over the outsole of the wearer's footwear.

The two ends of the lower leg wrap portion of the present disclosure are constructed from bonded leather, or suitable substitute material such a faux-leather vinyl material. The middle portion of the lower leg wrap portion features a supporting layer, made from a material of greater rigidity than the rigidity of the lower leg wrap. The supporting layer is dimensioned and has physical properties optimized for the display of an ornamental design, trademark, or logo.

The embodiments of the present disclosure wrap around the wearer's lower leg and are secured with hook-and-pile fasteners, such as VELCRO™, or the like, and are further secured to the wearer's lower leg with an adjustable-length stirrup strap. The adjustable-length stirrup strap is provided with a slideably adjustable buckle used to lengthen or shorten the strap, along with strap-loop fittings as part of a conventional two-part length-adjusting arrangement. The adjustable loop of the stirrup strap is operably coupled using a ring member to a base portion of the supporting layer; the opposite, fixed end of the stirrup strap is operably coupled proximate to a loose end of the lower leg wrap.

The summary above is not intended to describe each illustrated embodiment or every implementation of the present disclosure. The figures and the detailed description that follow more particularly exemplify these embodiments.

BRIEF DESCRIPTION OF THE DRAWINGS

The disclosure can be more completely understood in consideration of the following detailed description of various embodiments of the disclosure, in connection with the accompanying drawings, in which.

Figure 1:
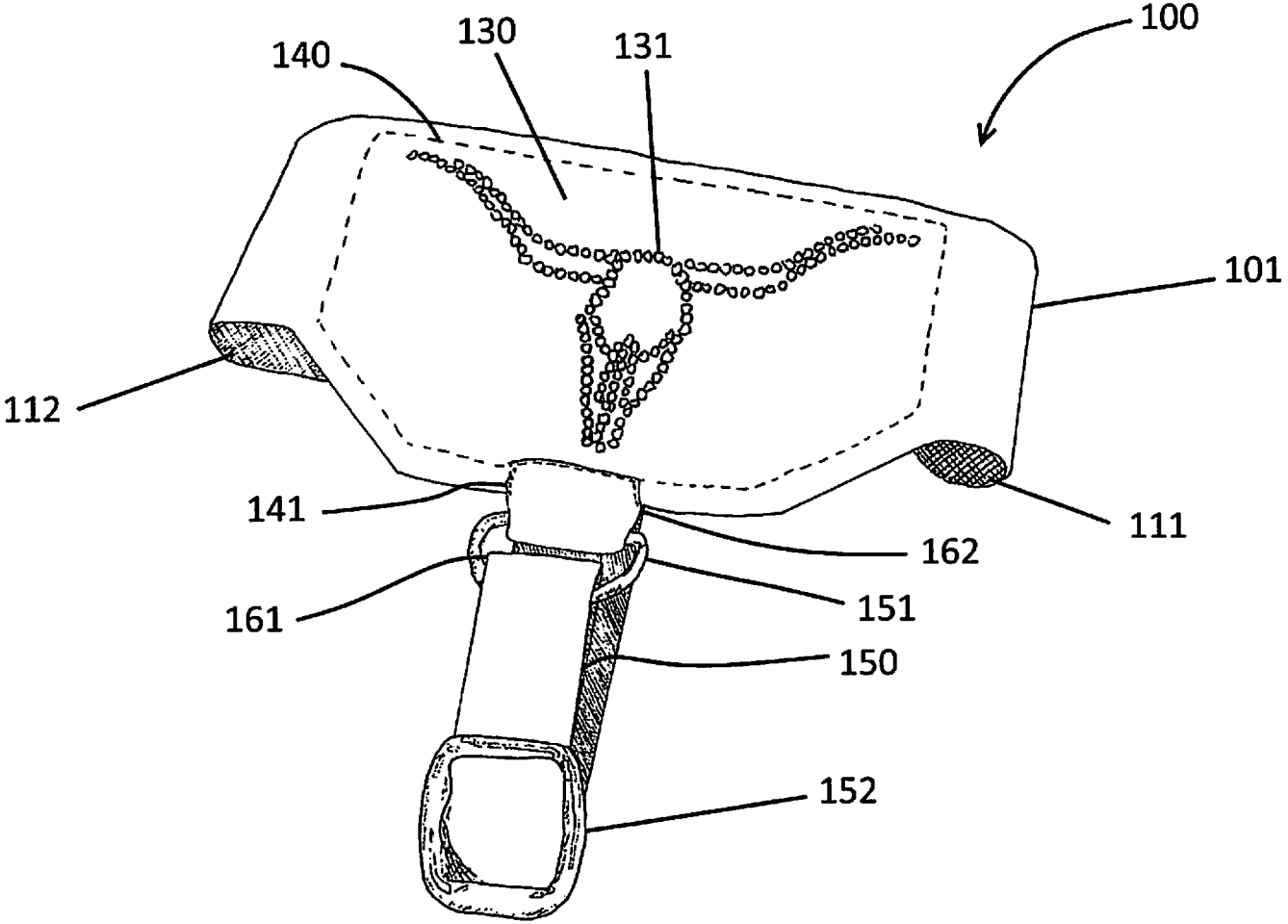
FIG. 1 is a schematic view depicting an interchangeable over-ankle band in accordance with an embodiment of the disclosure.

While embodiments of the disclosure are amenable to various modifications and alternative forms, specifics thereof shown by way of example in the drawings will be described in detail. It should be understood, however, that the intention is not to limit the disclosure to the particular embodiments described. On the contrary, the intention is to cover all modifications, equivalents, and alternatives falling within the spirit and scope of the subject matter as defined by the claims.

DETAILED DESCRIPTION

As shown in FIGS. 1-4, an interchangeable over-ankle band 100 for displaying an ornamental design 131 is depicted in accordance with an embodiment of the disclosure. In one embodiment, the interchangeable over-ankle band 100 includes a lower leg cuff 101, which has a first end 111 and second end 112, a first fastener 121 operably coupled to the lower leg cuff 101 proximate to the first end 111, and a second fastener 122 operably coupled to the lower leg cuff 101 proximate to the second end 112, the second fastener 122 corresponding to the first fastener 121. The first fastener 121 is coupled by the wearer to the second fastener 122 so as to form the lower leg cuff 101 into a loop surrounding the wearer's lower leg.

The lower leg cuff 101 has an outer surface 130 operating as a substrate for the display of an ornamental design 131. In one embodiment, as depicted in FIGS. 1-4, the wearer forms the lower leg cuff 101 into a loop surrounding her or his leg, such that an ornamental design 131 displays outward from the outer lateral portion of a wearer's lower leg, i.e. the wearer's out-step. In another embodiment, the wearer forms the lower leg cuff 101 into a loop surrounding her or his leg, such that an ornamental design 131 displays forward from the anterior portion of a wearer's lower leg, i.e. the wearer's shin. In still another embodiment the ornamental design 131 can be a trademark or logo. In one embodiment, the fasteners 121, 122 can be loop-and-pile type fasteners such as a VELCRO™ system.

Figure 2:
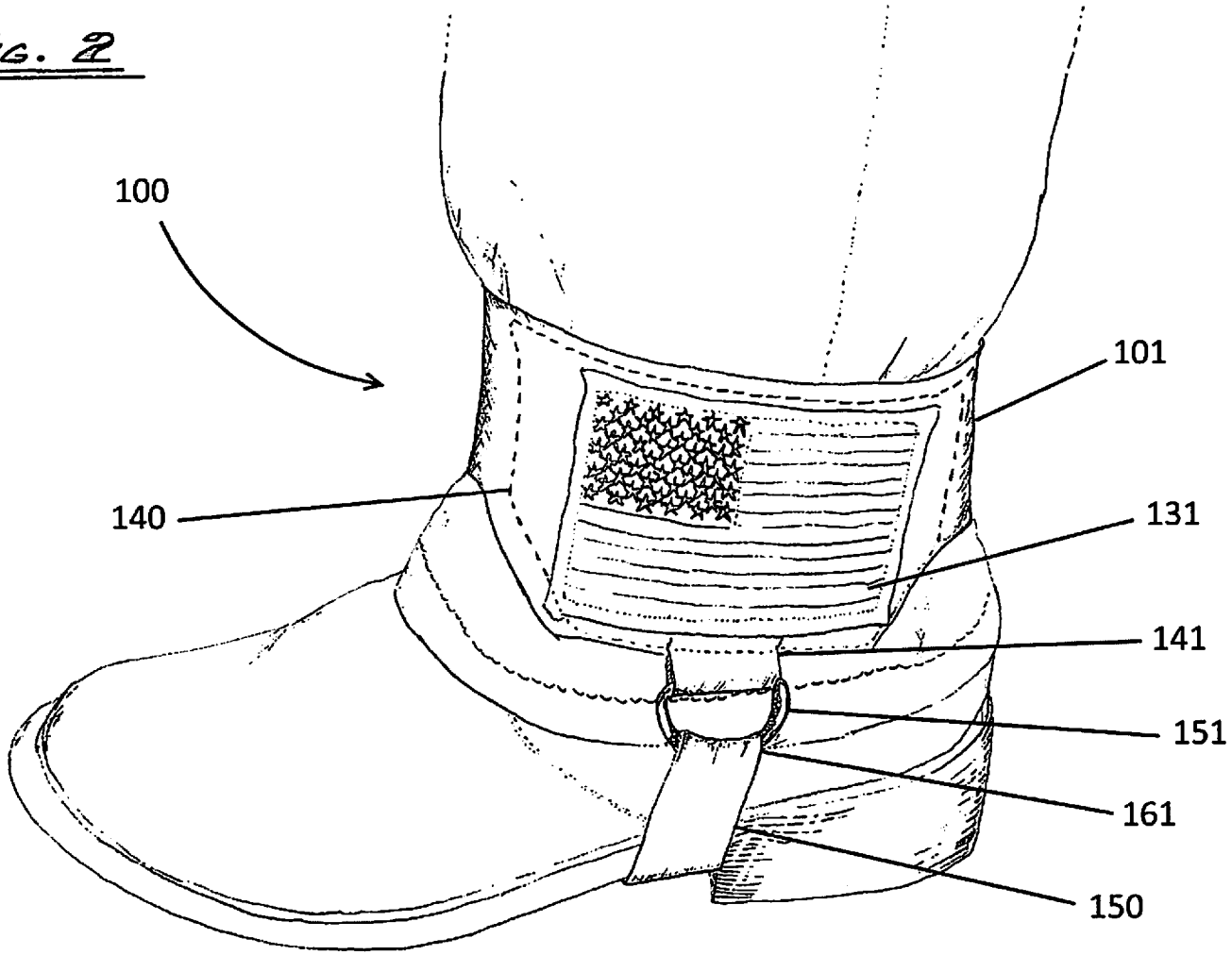
FIG. 2 is a perspective view depicting an interchangeable over-ankle band as worn on a wearer's left lower leg in accordance with an embodiment of the disclosure.
Figure 3:
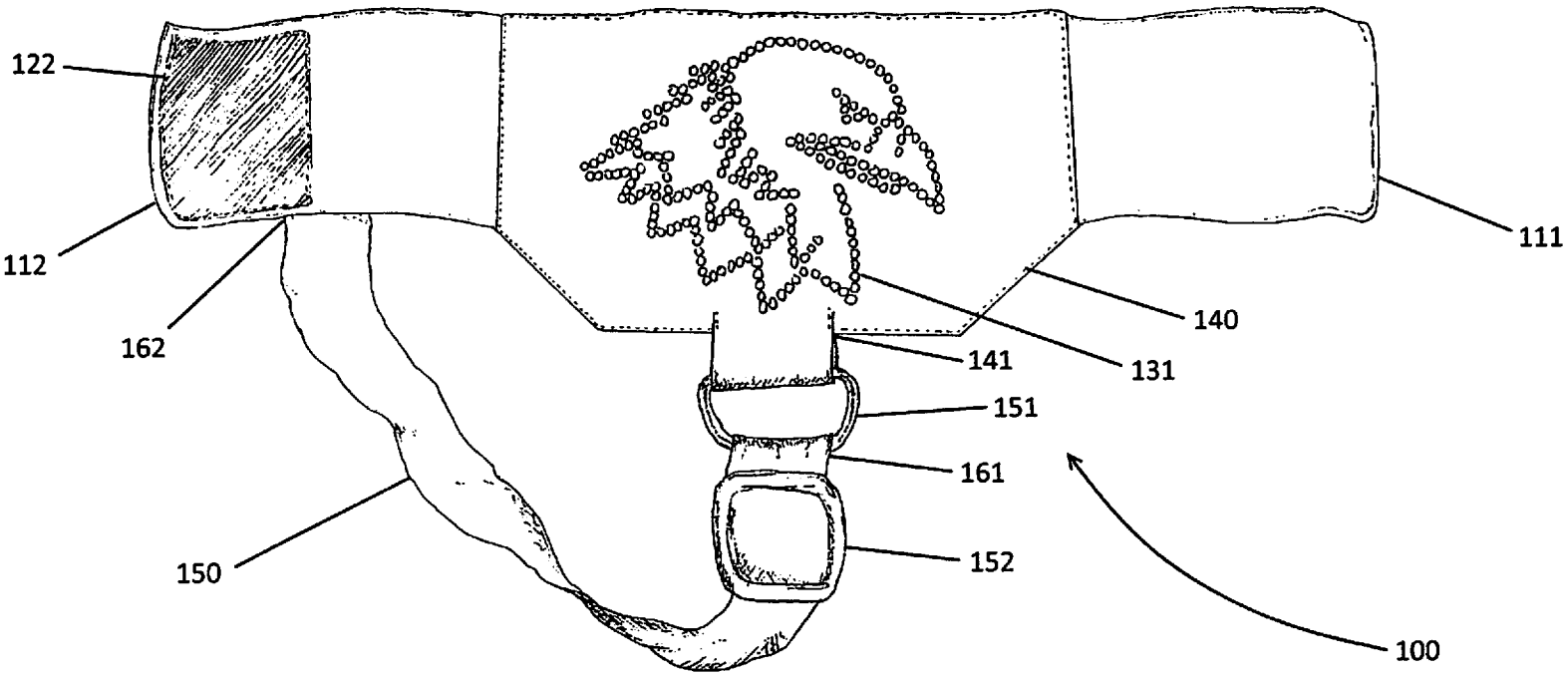
FIG. 3 is a frontal view depicting an exterior portion of an unworn and unfastened interchangeable over-ankle band in accordance with an embodiment of the disclosure.
Figure 4:
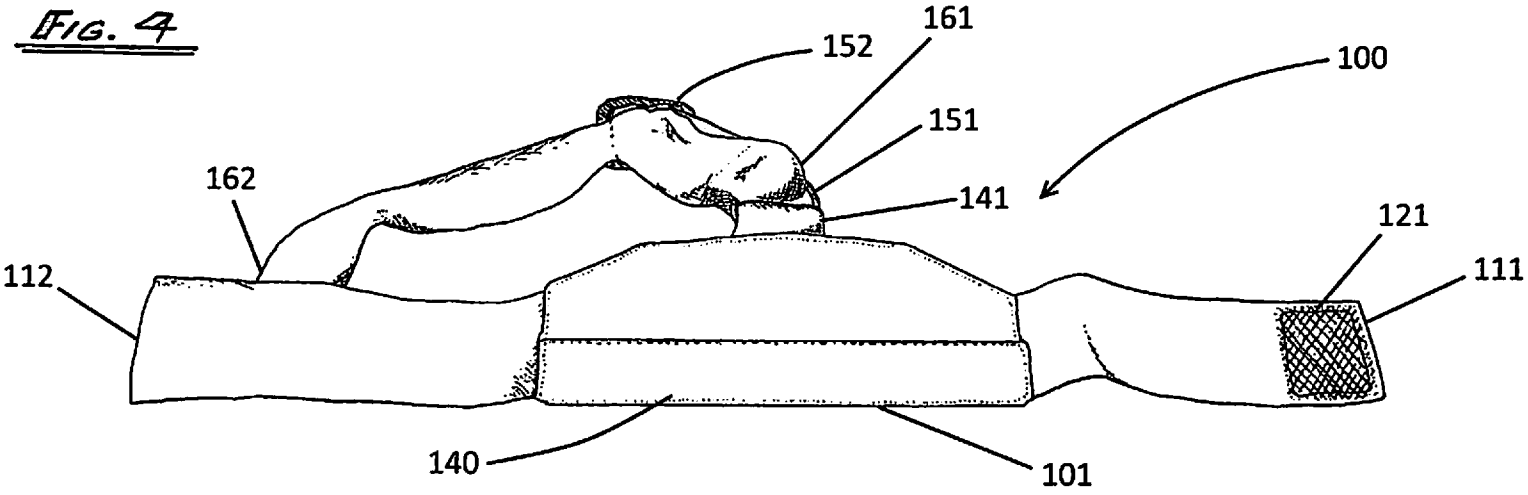
FIG. 4 is an overhead angular view of an interior portion of an unworn and unfastened interchangeable over-ankle band in accordance with an embodiment of the disclosure.

The interchangeable over-ankle band 100 has a supporting layer 140 made from a material having a rigidity greater than the rigidity of the lower leg cuff 101. Frontal views of the supporting layer 140 are depicted in FIGS. 1-3; a reverse view of the supporting layer 140 is depicted in FIG. 4. The supporting layer 140 provides a substantially inflexible "frame" material on the lower leg cuff 101 for display of an ornamental design 131. The rigid material reduces the likelihood of the ornamental design 131 from creasing, bending, buckling or otherwise deforming. Accordingly, unlike the prior art, embodiments of the present disclosure are suited for showcasing a particular ornamental design, trademark, or logo.

In one embodiment, the supporting layer is made from bonded leather. In another embodiment, the supporting layer may serve as substrate for a pocket, which the wearer can use to carry small items on her or his person. In still another embodiment, the supporting layer operates as a substrate for decorative embellishments, such as feathers, frills, or flowers.

In one embodiment, the supporting layer 140 has a bottom edge 141, to which a ring member 151 is operably coupled. As depicted in FIGS. 1-4, the interchangeable over-ankle band 100 features an adjustable-length stirrup strap 150, operably coupled to the ring member 151, which the wearer loops under the outsole of her or his footwear. The adjustable-length stirrup strap 150 has a first end 161 and a second end 162, and a slideably adjustable buckle 152 that forms a conventional buckle-loop assembly. The stirrup strap first end 161 is operably coupled to the ring member 151, forming the conventional buckle-loop assembly, which enables the wearer to slide the buckle 152 to adjust the length of the stirrup strap 150. The stirrup strap second end 162 is operably coupled proximate to the lower leg cuff second end 112. In one embodiment, the adjustable-length stirrup strap 150 is made from an elastomeric material, which provides for a snug fit over the wearer's footwear outsole.

The simplicity, ease-of-use, and relatively low manufacturing cost of embodiments of the present disclosure provide improvements over the prior art. Additionally, embodiments of the present disclosure are exceptionally lightweight and compact, enabling easy storage and transport, and minimizing encumbrances on the wearer. Embodiments of the present disclosure are sufficiently compact to fit neatly in a small handbag, e.g. a pocketbook.

Various embodiments of systems, devices, and methods have been described herein. These embodiments are given only by way of example and are not intended to limit the scope of the claimed inventions. It should be appreciated, moreover, that the various features of the embodiments that have been described may be combined in various ways to produce numerous additional embodiments. Moreover, while various materials, dimensions, shapes, configurations and locations, etc. have been described for use with disclosed embodiments, others besides those disclosed may be utilized without exceeding the scope of the claimed inventions.

Persons of ordinary skill in the relevant arts will recognize that the subject matter hereof may comprise fewer features than illustrated in any individual embodiment described above. The embodiments described herein are not meant to be an exhaustive presentation of the ways in which the various features of the subject matter hereof may be combined. Accordingly, the embodiments are not mutually exclusive combinations of features; rather, the various embodiments can comprise a combination of different individual features selected from different individual embodiments, as understood by persons of ordinary skill in the art. Moreover, elements described with respect to one embodiment can be implemented in other embodiments even when not described in such embodiments unless otherwise noted.

Although a dependent claim may refer in the claims to a specific combination with one or more other claims, other embodiments can also include a combination of the dependent claim with the subject matter of each other dependent claim or a combination of one or more features with other dependent or independent claims. Such combinations are proposed herein unless it is stated that a specific combination is not intended.

Any incorporation by reference of documents above is limited such that no subject matter is incorporated that is contrary to the explicit disclosure herein. Any incorporation by reference of documents above is further limited such that no claims included in the documents are incorporated by reference herein. Any incorporation by reference of documents above is yet further limited such that any definitions provided in the documents are not incorporated by reference herein unless expressly included herein.

For purposes of interpreting the claims, it is expressly intended that the provisions of 35 U.S.C. § 112(f) are not to be invoked unless the specific terms "means for" or "step for" are recited in a claim.

What is claimed is:

1. An interchangeable over-ankle band for the display of an ornamental design on the outer lateral portion of a lower leg of a wearer, the interchangeable over ankle band comprising:

a lower leg cuff having a first end and a second end, the lower leg cuff further having a first fastener operably coupled proximate to the first end, and a second fastener operably coupled proximate to the second end, the first and second fastener configured to selectively couple to one another so as to configure the lower leg cuff into a loop surrounding the lower leg of the wearer so as to define an outer surface operating as a substrate for the display of an ornamental design or logo;

a supporting layer operably coupled to the lower leg cuff, the supporting layer having a rigidity greater than that of the lower leg cuff, and a bottom edge portion;

a ring member operably coupled to the bottom edge portion of the supporting layer; and an adjustable-length stirrup strap having a first end and a second end, the first end of the adjustable-length stirrup strap operably coupled to the ring member, and the second end of the adjustable-length stirrup strap operably coupled proximate to the second end of the lower leg cuff, the adjustable-length stirrup strap having a slideably adjustable buckle-loop assembly for adjusting the length of the stirrup strap to fit an outsole of a footwear of the wearer.

2. The interchangeable over-ankle band in claim 1, wherein the supporting layer is at least partially constructed of bonded leather.

3. The interchangeable over-ankle band in claim 1, wherein the adjustable stirrup strap is elastomeric.

4. The interchangeable over-ankle band in claim 1, further comprising a pocket operably coupled to the supporting layer.

5. The interchangeable over-ankle band in claim 1, further comprising decorative embellishments bonded to the exterior portion of the supporting layer.

6. The interchangeable over-ankle band in claim 5, wherein the decorative embellishments include one of feathers, frills, artificial flowers, and a combination thereof.

* * * * *